United States Patent [19]

Fitzpatrick

[11] 4,450,667

[45] May 29, 1984

[54] METHOD AND APPARATUS FOR REJUVENATING RUBBER BALLS AND THE LIKE

[76] Inventor: John Fitzpatrick, 689 Fairchild Ave., Trumbull, Conn.

[21] Appl. No.: 296,991

[22] Filed: Aug. 27, 1981

[51] Int. Cl.[3] ..... B65B 63/08; A63B 47/00; H05B 3/06

[52] U.S. Cl. ..... 53/127; 34/218; 273/61 D

[58] Field of Search ..... 53/407, 432, 403, 440, 53/88, 425, 127; 264/36; 273/61 D; 206/315 B; 261/DIG. 76; 34/218

[56] References Cited

U.S. PATENT DOCUMENTS

| | | | |
|---|---|---|---|
| 1,276,987 | 8/1918 | Stockton | 273/61 D |
| 1,296,215 | 3/1919 | Ray | 34/218 |
| 2,012,283 | 8/1935 | Miller | 273/61 D |
| 2,260,710 | 10/1941 | Gschwind | 34/218 X |
| 2,393,491 | 1/1946 | Wolf | 53/407 X |
| 2,457,867 | 1/1949 | Chambers | 53/407 X |
| 2,855,006 | 10/1958 | Geisler | 53/407 X |
| 3,853,222 | 12/1974 | Helms | 53/88 X |
| 4,031,688 | 6/1977 | Wasserman | 53/403 |

FOREIGN PATENT DOCUMENTS

| | | | |
|---|---|---|---|
| 1572813 | 8/1980 | United Kingdom | 273/61 D |
| 2060325 | 4/1981 | United Kingdom | 273/61 D |

*Primary Examiner*—Horace M. Culver
*Attorney, Agent, or Firm*—Arthur T. Fattibene

[57] ABSTRACT

A method and apparatus for rejuvenating worn or used balls, e.g. balls used in the game of racket ball by subjecting such worn or used balls to steam heat while confining such balls to a closed environment. The apparatus comprises a container, such as the can in which such balls are normally marketed and connecting thereto the outlet of a steam generating device whereby the balls normally stored in the container are subjected to steam heat generated with the steaming device.

1 Claim, 6 Drawing Figures

FIG. 4
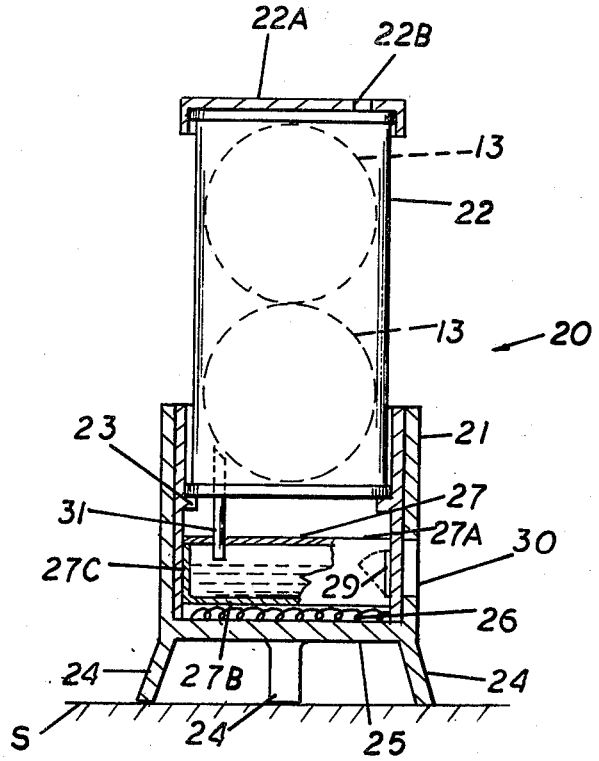
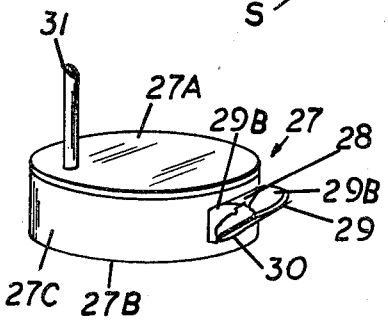
FIG. 5
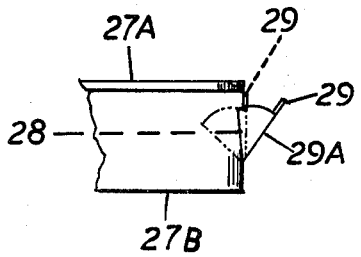
FIG. 6

METHOD AND APPARATUS FOR REJUVENATING RUBBER BALLS AND THE LIKE

PROBLEMS AND PRIOR ART

Balls commonly used in the game or sport of racket ball are formed of rubber or rubber like material, and are usually marketed in sealed containers. Experience has shown that after a few games of use, such balls loose their "bounce" causing the balls to become "dead". As a result such balls have a relatively short life. For this reason those who participate in racket ball are constantly confronted with the expense of purchasing new balls.

It has been known, e.g. with tennis balls, that the bounce of such tennis balls can be sustained by marketing such balls in hermetically sealed cans and/or subjecting such balls to a pressure such as is taught in U.S. Pat. Nos. 4,161,247; 4,019,629; 3,233,727; 3,889,807; and 2,012,283. Also, golf balls which have been hit so often that they become dented, pitted or misshapen or out of round have been restored to a limited extent by subjecting such golf balls to heat and reforming or reshaping pressures such as disclosed in U.S. Pat. No. 1,533,563.

OBJECTS

An object of this invention is to provide a method and apparatus for rejuvenating balls for use in racket ball by subjecting the balls to an enclosed steam environment.

Another object is to provide a steaming apparatus for rejuvenating racket balls utilizing the racket ball container as the steaming environment enclosure.

Another object is to provide an apparatus for rejuvenating racket balls in which the racket ball container is utilized in conjunction with a heat source to generate steam.

Another object is to provide a method and apparatus for rejuvenating racket balls which is relatively simple and which apparatus is relatively inexpensive and positive in operation.

BRIEF SUMMARY OF THE INVENTION

The foregoing objects and other features and advantages are attained by the method of generating steam and bringing the steam into contact with the balls to be rejuvenated in a closed container and maintaining the balls to such steam environment for a predetermined period of time. The apparatus by which the method may be carried out comprises a container, which may be the container in which the racket balls are normally merchanised and which container is connected up to a source of steam. In one embodiment the steam can be generated in a conventional tea kettle type vessel in which the steam outlet is channeled by way of a connecting conduit to the container containing the balls.

In another embodiment a stand is provided which has a build in heat source. A water container defining a reservoir is disposed within the stand in heat transfer relationships to the heat source for generating steam. The reservoir or water container is provided with an access opening closed by a pivoting spout by which the water container can be filled. Supported above the water container within the stand and in communication therewith is the ball container for receiving the balls to be rejuvenated.

To rejuvenate the balls steam is generated and is directed to the ball container in which the balls are enclosed. It has been discovered that by so subjecting the balls to a steam environment, the resiliency of the balls is enhanced and the balls are rendered sufficiently "alive" so that they can be further used.

FEATURES

A feature of this invention resides in a relatively simple apparatus comprising a steam generating device having its outlet connected to a ball container where the balls therein are subjected to a steam environment.

Another feature resides in an apparatus for rejuvenating racket balls having a stand containing a built in heat source and a removable water container for generating steam for use in reactivating racket balls.

Another feature resides in the provision of utilizing the racket ball storage container as the steam vessel for rejuvenating racket balls, Other features and advantages will become more readily apparent when considered in view of the drawings and specifications in which:

FIG. 4 is a section side view of a modified embodiment.

FIG. 5 is a detailed perspective view of the water container of FIG. 4.

FIG. 6 is a sectional view of a detail of construction.

DETAIL DESCRIPTION

In accordance with this invention the balls used in the game of racket ball are generally a hollow formed spherical body formed of a rubber or rubber like material. After a few games of play such balls normally loose their "bounce" and become "dead" making them no longer suitable for the play of the game. Such balls it has been discovered can be rejuvenated by subjecting such "dead" balls to an enclosed steam environment. According to this invention this is attained by generating steam by applying heat to a water supply and conducting the steam so generated to a closed container in which the balls are normally stored.

Figure 1:
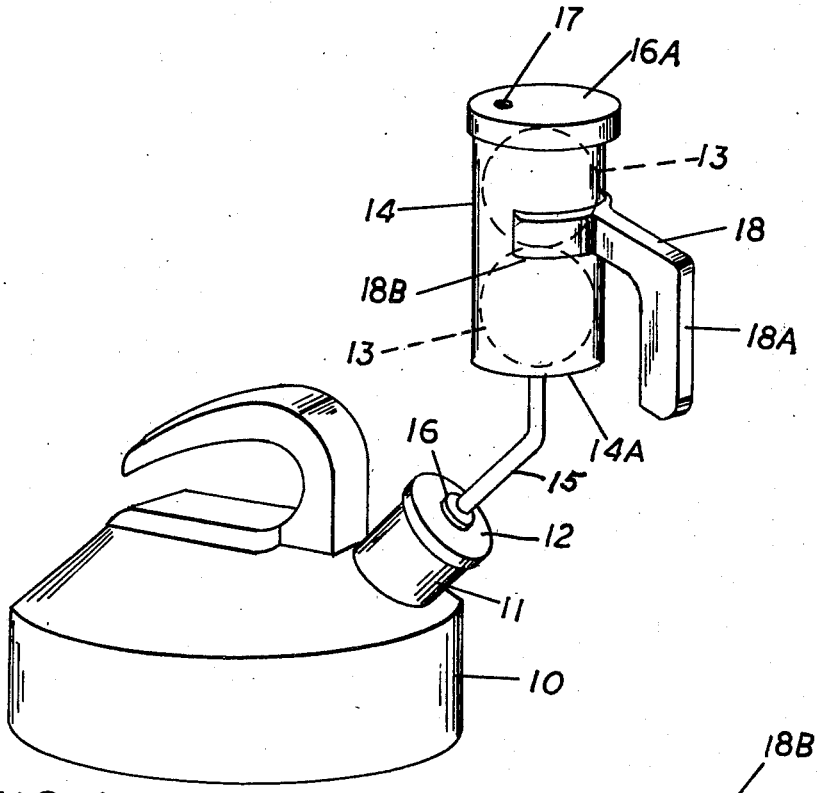
FIG. 1 is a perspective view of one embodiment of the invention.
Figure 3:
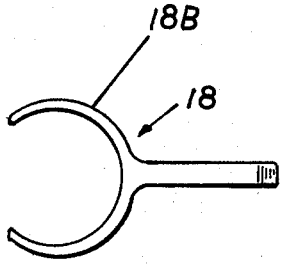
FIG. 3 is a top view of a handle member.
Figure 2:
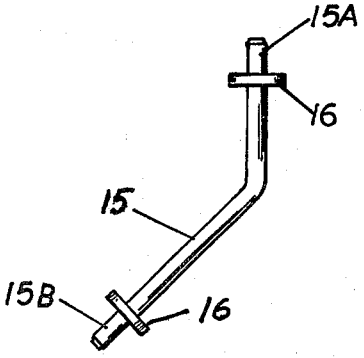
FIG. 2 is a detail view of the connecting steam conduit.

As best seen in FIG. 1 this can be effected by generating steam in a conventional type vessel such as a tea pot or kettle 10. The spout or steam outlet 11 of the kettle 10 is provided with a cover or closure 12 which is provided with an opening therein.

The balls 13 to be rejuvenated are disposed in a ball container 14. Such container 14 may be the container in which such balls are normally marketed and kept. To adapt such container 14 for the practice of the method described above, the bottom 14A is provided in a hole for receiving the end 15A of a connecting steam conduit 15. The other end 15B of the steam conduit 15 is received in the hole formed in the closure 12. Circumscribing the conduit 15 adjacent the respective ends 15A and 15B is a sealing washer or packing 16. Thus as shown in FIG. 1, the steaming enclosure or ball container 14 can be readily connected to a steam kettle simply by interconnecting the steam conduit 15 between the kettle spout 11 and the bottom 14A of the ball container 14.

The open end of the container 14 is sealed closed by a cover or top 16A. In the illustrated embodiment the cover or top 16A is provided with a small vent opening 17 so as to prohibit any excessive build up of steam pressure within the ball container 14 when the balls 13 are being steamed.

To facilitate holding the ball container 14 during the steaming operation, a handle 18 is provided. The handle is provided with a suitable gripping portion 18A which has connected thereto a fragmented ring portion 18B which is sized to frictional grip a circumferential portion of the ball container. It will be understood that the handle 18 may be formed of a suitable heat resistant material so as to minimize thermal conduction therethrough.

To rejuvenate the "dead" or "used" racket balls, the balls and the container are hooked up to a steam kettle or vessel 10 as described whereby the steam generated is conducted to the ball container 14 and the balls therein. By subjecting the balls 13 to this steam heat for a predetermined time, e.g. 15 to 20 minutes, the balls 13 will recapture their "bounce" or "liveliness".

FIGS. 4 to 6 illustrate another modified form of the invention. In this form of the invention the steaming apparatus 20 comprises a stand 21 having a tubular body portion adapted to receive the container 22 in which the balls 13 are stored. As shown the stand 21 is provided with an internal annular flange 23 to define a support for the ball container 22. The body of the stand is supported on leg members 24 to space the bottom of the stand off a supporting surface S.

Located adjacent the bottom 25 of the stand 21 is an electric heater 26. Disposed in heat transfer relationship with the heater 26 is a water container or reservoir 27. As best seen in FIGS. 5 and 6 the reservoir container includes a closed vessel defined by a top and bottom wall 27A and 27B connected to a circumscribing side wall 27C.

An access opening 28 is provided in the side wall 27C of the water container 27. According to this invention the access opening 28 is closed by a pivoting spout closure 29. As shown the pivoting spout closure 29 is defined by a front wall 29A interconnecting between opposed side walls 29B—29B, which are arranged to slide adjacent the opposed edges of the access opening 28. A suitable hinge 30 pivotably connects the spout closure to the wall portion of the water container. The arrangement is such that when the spout closure is pivoted to the dotted line position of FIG. 6, the water container is sealed closed. To fill the container the spout closure is pivoted to the open position, as shown in the solid line showing of FIG. 6.

To accommodate the pivoting of the spout closure 29, a portion of the stand adjacent the spout 29 is provided with an opening 30. Thus the spout closure 29 is rendered readily accessible so that water can be readily added to the reservoir when the apparatus 20 is in use.

Extending above the top 27A of the water container 27 is a steam conduit or outlet 31. The steam conduit, when in use extends through the bottom of the ball container so as to communicate with the interior of the ball container 22. The top of the ball container 22 is closed by a top or cover 22A. Formed in the cover 22A is a small vent opening 22B.

To operate apparatus 20 to rejuvenate the balls 13, requires merely filling the water container 27 with water through its spout closure 29, and thereafter pivoting the spout 29 to its closed position. The ball container 22 is positioned within the stand so that the steam conduit extends thereinto. The electric heaters are then energized to generate the steam which is directed to the ball container 22 enclosing the balls 13. The steam heat acting on the balls for a predetermined time thus functions to bring back "life" to the balls, so that the otherwise "dead" ball can be satisfactorily used for additional play.

While the invention has been described with respect to certain embodiments, it will be readily understood and appreciated that variations and modifications may be made without departing from the spirit or scope of the invention.

I claim:

1. An apparatus for rejuvenating balls of the type used in the sport of racket ball or the like comprising a stand, having extending tubular wall portions, said stand having a full open top, leg means for supporting said stand in spaced relationship to a supporting surface, a heating means in the form of an electric resistance coil disposed adjacent the bottom of said stand, said stand having an opening formed in a wall portion thereof adjacent the bottom thereof, an inturned annular support disposed intermediate the height of said stand, a reservior container sized to be received in said stand, said reservoir container having an access opening disposed opposite to said stand opening, a spout hingedly connected to said reservoir opening to pivot between a close and open position relative to said access opening, whereby in the open position said spout extends beyond the opening in said stand, a steam conduit extending upwardly from said reservoir container and means defining a ball container for housing the balls to be rejuvenated, said ball container being sized to be received in said stand annular support above said reservoir container, said ball container having a bottom wall formed with a hole therein, said steam conduit extending into said hole formed in the bottom of said ball container, a cover for sealing the upper end of said ball container, and a vent means formed in said cover.

* * * * *